United States Patent [19]

Zandman et al.

[11] Patent Number: 4,570,150

[45] Date of Patent: Feb. 11, 1986

[54] PRECISION RESISTOR AND METHOD OF MAKING SAME

[75] Inventors: Felix Zandman, Philadelphia; Frank P. Sandone, Jr, Malvern, both of Pa.

[73] Assignee: Vishay Intertechnology, Inc., Malvern, Pa.

[21] Appl. No.: 561,306

[22] Filed: Dec. 14, 1983

[51] Int. Cl.[4] ..... H01C 1/144

[52] U.S. Cl. ..... 338/329; 29/613; 338/275; 338/314

[58] Field of Search ..... 338/7, 195, 254, 275, 338/308, 309, 314, 320, 322, 327, 328, 329; 29/610 R, 613, 619, 620, 621; 219/541, 543

[56] References Cited

U.S. PATENT DOCUMENTS

| | | | |
|---|---|---|---|
| 3,405,381 | 10/1968 | Zandman et al. | 338/254 |
| 3,849,755 | 11/1974 | Khammous et al. | 338/320 |
| 4,138,656 | 2/1979 | Resnicow | 338/322 |
| 4,286,249 | 8/1981 | Lewis et al. | 338/275 |
| 4,318,072 | 3/1982 | Zandman | 338/275 X |
| 4,378,549 | 3/1983 | Szwarc | 338/195 |
| 4,396,900 | 8/1983 | Hall | 338/309 |

*Primary Examiner*—Volodymyr Y. Mayewsky
*Attorney, Agent, or Firm*—Weiser & Stapler

[57] ABSTRACT

A precision resistor of the type formed by defining a resistive path in a thin foil of resistance material attached to a substrate. Metallic interface layers are deposited on terminal pads between which the resistive path extends, so that when solder-coated copper leads are spot-welded to the terminal pads, the junction between the copper leads and the terminal pads is both a spot-weld and a solder connection.

10 Claims, 2 Drawing Figures

PRECISION RESISTOR AND METHOD OF MAKING SAME

Figure 1:
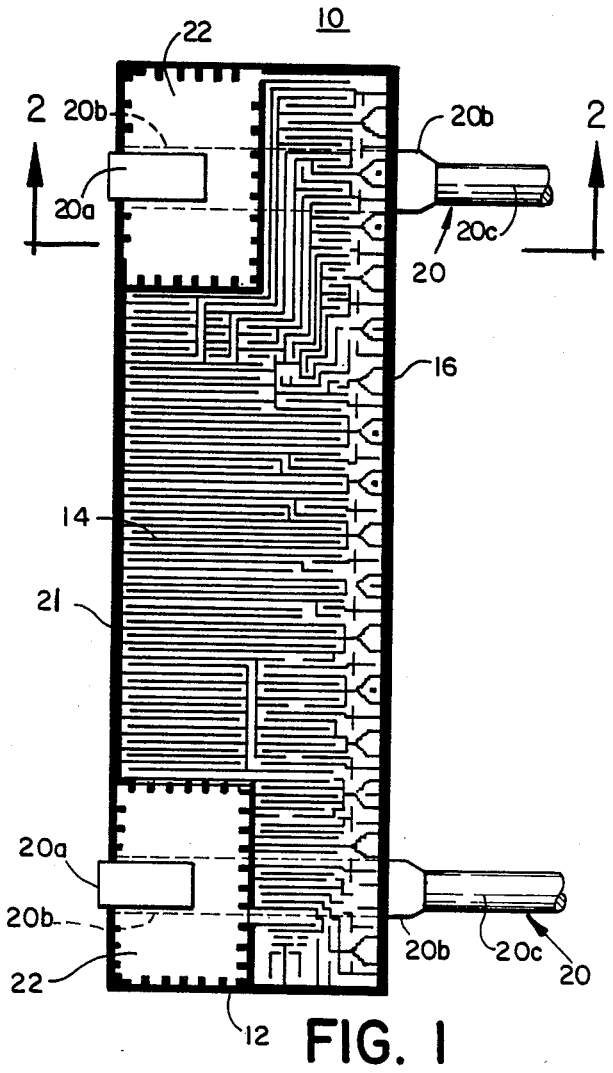

The present invention relates, in general, to electrical components and, in particular, to precision resistors formed by defining a resistive path in a thin foil of resistance material attached to a substrate.

It is well known to fabricate resistors by photoetching a suitable pattern on a thin foil cemented to a rigid substrate (e.g. glass, ceramic, or metal) with the etched pattern corresponding to the desired resistance value. The pattern then can be further adjusted, if necessary, to the appropriate tolerance by cutting lines in the pattern or reducing its thickness. As a result, there is created between two terminal pads of the foil an elongated path of the resistive material exhibiting the desired value of resistance.

Precision resistors of this type and various aspects thereof have been the subject of prior inventive activity. By way of illustration, reference is made to U.S. Pat. No. 3,405,381 to Zandman et al, U.S. Pat. No. 3,517,436 to Zandman et al, U.S. Pat. No. 3,718,883 to Berman et al, U.S. Pat. No. 4,138,656 to Resnicow, and U.S. Pat. No. 4,172,249 to Szwarc. All of these patents are assigned to the same assignee as the present application, and their contents are hereby incorporated in this application by reference as fully as though set forth at length herein.

A major problem in the fabrication of this type of precision resistor is attaching leads to the resistive pattern. A number of techniques have been used in the past with varying degrees of success. One employs a thin ribbon as the connecting link between the thin foil and a heavy copper lead. This approach provides both a means for welding the ribbon connecting link to the thin foil and also reduces the stresses which can be transmitted from the heavy copper lead to the resistor. However, other problems arise. Because very dissimilar materials are used in the foil, ribbon and lead, high thermal EMF's are developed. Also, the ribbon is relatively fragile and can tear. In addition, the ribbon does not provide the neccessary support or positioning of the resistor in a mold cavity to permit encapsulation of the assembly by automatic molding methods.

Other attachment techniques, used in the past, include thermal and ultrasonic wire bonding. These techniques, like the use of a thin ribbon, exhibit the problems of fragility and lack of support.

An improvement over the ribbon connecting link was the development of a unitized lead which was directly connected to the foil. U.S. Pat. No. 4,286,249 to Lewis et al and U.S. Pat. No. 4,138,656 to Resnicow et al describe and illustrate this technique. These two patents also are assigned to the same assignee as the present application and their contents are hereby incorporated in this application by reference as fully as though set forth at length herein. In these two patents, the copper leads are flattened at their ends and directly spot-welded to terminal pads between which the resistive path extends. By using rigid leads, secured to the substrate, automatic molding methods can be used effectively to encapsulate the assembly.

Although much improvement has been gained by the attachment technique described and illustrated in the Lewis et al and Resnicow et al patents, there still remains the problem of welding together two materials with large differences in thickness and resistivity. The foil thickness typically is approximately 100 microinches, while the flattened lead end is approximately 0.005" to 0.010" thick. The foil typically is a nickel-chrome alloy having a high resistivity, while the lead typically is a solder-coated copper wire having a low resistivity.

This mismatch between foil and lead requires exacting control of the welding operation to produce consistently reliable welds under production conditions. Among the problems associated with the combination of a nickel-chrome alloy foil and a solder-coated copper lead is that the nickel-chrome alloy forms a surface oxidation which affects welding and other lead attachment techniques such as soldering. To overcome this condition, weld parameters which produce high temperatures and pressure to insure a good weld are required. The temperature and pressure necessary to provide the proper interface conditions between an oxide coated foil and a solder-coated lead causes the bonding resin which holds the foil to its substrate to soften. Softening of the bonding resin with the application of downward pressure from the weld electrode causes depression in the lead material, movement of the foil, and possible serious deformation, tearing or cracking of the foil due to the resin movement and lack of support. Reducing the weld temperature and pressure to avoid these problems increases the risk of developing a "cold" weld, in which the two materials are not intimately joined.

Soldering is another technique for attaching a lead to the resistive pattern. However, soldering also presents certain problems. For example, very clean surfaces are required. Also, fluxes which can be corrosive are used. In addition, "cold" solder joints are produced due to a variety of reasons at an unacceptable rate.

U.S. Pat. No. 4,176,445 to Solow describes and illustrates a foil resistor in which a copper lead is soldered to a nickel-chrome foil which has previously been plated with copper, gold, or nickel gold. The gold plating provides some improvements over soldering the lead to a bare, oxide coated foil, but the joint remains a soldered connection which is not considered as desirable as a welded junction.

Accordingly, it is an object of the present invention to provide a new and improved precision resistor of the type in which a thin foil of resistance material is attached to a substrate and defines a resistive path extending between two terminal pads, and solder-coated connecting leads are secured to the pads.

It is another object of the present invention to provide such a resistor in which the junctions of the connecting leads and the terminal pads are electrically and mechanically reliable.

These and other objects which will appear are achieved in accordance with the present invention by providing a metallic interface layer between the thin foil terminal pads and the solder-coated connecting leads and spot-welding the leads to the pads under such conditions that the heat of the spot-welding (a) welds the leads to the thin foil, and (b) causes the solder-coating of the leads to also wet the thin foil, producing a solder joint.

Figure 2:
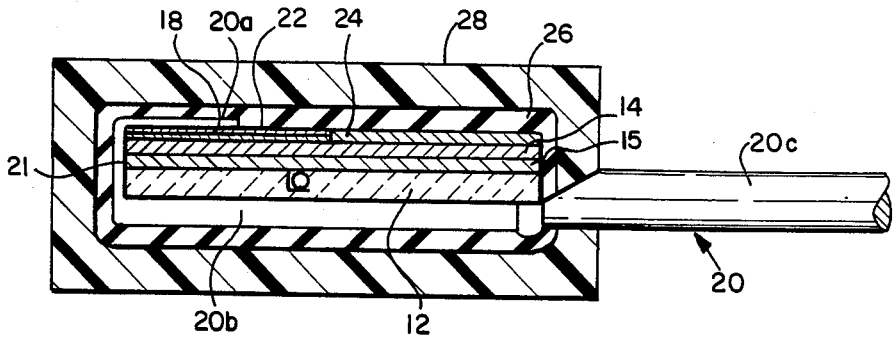

Referring to the drawing:

FIG. 1 is a plan view of the basic configuration of a foil-bearing substrate with flattened copper leads attached to the terminal pads; and FIG. 2 is a cross-sectional elevation, on an enlarged scale, taken along line 2—2 of the assembly of FIG. 1, encapsulated in its various protective elements.

FIGS. 1 and 2 show an assembly 10 of a substrate 12, which may for example be made of ceramic, and upon which there is a foil 14 of resistive material, e.g. nickel-chromium foil having a thickness of 30–250 microinches. Foil 14 is attached to substrate 12 by a layer of cement 15. Initially, foil 14 may extend continuously over substantially the entire substrate 12. However, by the time the stage of manufacture shown in FIG. 1 has been reached, the foil has already been subjected to a series of treatments of known type, as a result of which there is formed in the foil an extended serpentine path separated by thin divisions. The pattern of the foil also can be developed before cementing, using a temporary support. Also provided along the edge of foil 14 are tab portions 16, in which it is possible to make cuts through the foil during the process of adjusting the resistance of the component during a subsequent stage of manufacture. Also provided in foil 14 are terminal pads 18 at which the opposite ends of the serpentine path terminate.

External connections to foil 14 are made by means of leads 20. These consist of solder-coated copper leads which are flat and comparatively thin e.g. 5–10 mils and narrow in those end portions 20*a* that extend onto the substrate assembly. These end portions 20*a* of the leads then turn downwardly past the long edge 21 of substrate 12. At the bottom of substrate 12, leads 20 then turn again and pass across the reverse side of the substrate. These portions 20*b* of leads 20, indicated in broken lines in FIG. 1, also are flat but preferably both thicker and wider than end portions 20*a*. Finally, leads 20 have portions 20*c* which may be round, square or rectangular. In practice, lead portions 20*a*, 20*b*, and 20*c* may be formed from the same copper wire stock. Portions 20*a* and 20*b* may be formed from that stock by suitably flattening the ends. The widened intermediate portion 20*b* may be simply the inherent result of lateral spreading of the lead during flattening. On the other hand, the narrower end portion 20*a* may be formed by appropriately cutting away lateral edge portions of the flattened lead over the length of portion 20*a*.

As stated previously, leads 20 can be attached to assembly 10 by means of spot-welding, which is the preferred technique for achieving the desired electrical connection and mechanical fixation. In order to develop a more reliable electrical connection and mechanical fixation, a metallic interface layer 22 is provided between pads 18 and ends 20*a* of the leads according to the present invention. Interface layer 22 may be gold or another suitable metal (see below) which is applied by plating or other suitable means to pads 18. By providing interface layer 22, the weld parameters required to make the desired junction can be decreased. Lower temperatures are developed which minimize resin flow and less pressure is required which minimizes foil movement, in turn, reducing foil deformation and damage. The use of an interface layer over the pad portions of the foil also eliminates the problem of an oxide layer on the foil because the oxide layer is removed during surface cleaning prior to depositing the interface layer and the interface layer protects the foil surface from reoxiding.

In addition to producing an enhanced weld junction, the interface layer promotes "wetting" of the solder coating of the leads to the foil in the peripheral areas around this weld site, producing a solder junction between the leads and the pads. This adds to the strength and integrity of the joint in that both a welded and soldered junction are formed.

Different materials can be used as interface layer 22. Gold, copper, platinum, rhodium, palladium or layered platings such as nickel strike followed by a gold plating can be employed. Also, other deposition techniques besides plating can be used to apply interface layer 22 to pads 18. For example, it has been demonstrated that a copper film sputtered to a nickel chrome foil will produce the desired result. Also, vapor or vacuum deposition techniques may be employed.

In a specific example of the present invention, 100 microinch thick layers of gold were plated onto the thin foil pads. The cold plating was a commercial preparation manufactured by the Selrex Corporation which consisted of the following (a) gold strike solution—Aurobond TCL; (b) gold plate solution—Autronex CI. The gold strike was accomplished in sixty seconds at thirty amperes per square foot, and the gold plate was accomplished in thirty minutes at ten amperes per square foot. Welding was accomplished with a direct energy (a.c.) welding system. Weld voltages of approximately 0.8 volts and forces of approximately 2.75 pounds were used. The improved intergrity of the weld joints was determined by destructive pull tests to indicate the strength of the joints and to visually observe the surface-to-surface condition present in the weld site.

In a second example, similar to the first one, 0.001" layers of copper were plated onto the thin foil pads. The copper plating was applied using a typical copper fluoroborate bath. The copper strike was first applied at seven amperes per square foot and sixty seconds followed by a copper plate at thirty amperes per square foot and thirty minutes.

As shown in FIG. 2, a protective overcoat 24, preferably epoxy, is placed above foil 14 for the protection of the serpentine path. Overcoat 24 does not extend over pads 18 which are covered by interface layer 22.

Enveloping the assembly between protective overcoat 24 on the top and the bottom surface of substrate 12, including portions 20*b* of the leads, is a cushion 26 which is made of soft rubber or rubber-like material. Further enclosing cushion 26 is an outer envelope 28, which may be either of molded plastic, such as epoxy, or may be a plastic case into which the other elements have previously been inserted and which then is filled with encapsulating material, such as epoxy. The use of hermetic packages, filled or unfilled, are also acceptable.

Copper leads 20, and particularly their conventional portions 20*c*, protrude outwardly from outer envelope 28 and serve as external connections to the resistor.

We claim:

1. A precision resistor comprising:

a substrate;

a thin foil of a nickel-chrome alloy adhered to said substrate and defining a resistive path extending between two terminal pads;

a thin metallic interface layer on each of said terminal pads; and a copper lead having an end which lies upon said metallic interface layer and which is simultaneously spot-welded and soldered to said terminal pad by electric discharge.

2. A precision resistor according to claim 1 wherein said copper lead is a flattened end portion of a conventional copper wire.

3. A precision resistor according to claim 1 wherein the metal of said interface layer is selected from the group consisting of gold, copper, platinum, rhodium and palladium.

4. A precision resistor according to claim 1 further including a protective overcoat covering at least the resistive path of the foil.

5. A precision resistor according to claim 4 further including:

(a) a soft, rubber-like cushion enveloping said substrate, foil, matallic interface layer, ends of said copper leads, and overcoat; and (b) means providing an outer encapsulation for the resistor, the copper leads protruding through said outer encapsulation means.

6. A precision resistor according to claim 1 wherein the nickel-chrome foil has a thickness of between 30 and 250 microinches.

7. A precision resistor according to claim 1 wherein the end of the copper lead has a thickness of between 5 and 10 mils.

8. A precision resistor according to claim 1 wherein the metallic interface layer is at least one order of magnitude thinner than the nickel-chrome foil.

9. A precision resistor comprising:

a substrate;

a thin foil of a nickel-chrome alloy having a thickness of between 30 and 250 micorinches, adhered to said substrate and defining a resistive path extending between two terminal pads;

a thin metallic interface layer on each of said terminal pads, which layer is at least one order of magnitude thinner than said foil; and a copper lead, an end of which, having a thickness of between 5 and 10 mils, lies upon said metallic interface layer and is simultaneously spot-welded and soldered to said terminal pad by electric discharge.

10. A precision resistor made by:

defining in a thin foil of a nickel-chrome alloy attached to a substrate a resistive path extending between two terminal pads;

applying a thin metallic interface material to each of said terminal pads;

placing solder-coated copper leads on said metallic interface material; and spot-welding said leads to said pads under such conditions that the heat of the spot-welding simultaneously (a) welds said leads to said foil, and (b) causes the solder-coating of said leads to wet said foil, to solder said leads to said foil.

* * * * *